US010300321B2

(12) United States Patent
Hsu

(10) Patent No.: US 10,300,321 B2
(45) Date of Patent: May 28, 2019

(54) EXERCISE BICYCLE CONFIGURED TO PROVIDE FAN-BASED RESISTANCE AND FAN WHEEL THEREOF

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 87 days.

(21) Appl. No.: 15/454,222

(22) Filed: Mar. 9, 2017

(65) Prior Publication Data

US 2018/0256932 A1 Sep. 13, 2018

(51) Int. Cl.

| | |
|---|---|
| ***A63B 21/008*** | (2006.01) |
| ***F04D 29/28*** | (2006.01) |
| ***F04D 29/62*** | (2006.01) |
| ***F04D 29/30*** | (2006.01) |
| ***A63B 22/06*** | (2006.01) |
| ***A63B 23/035*** | (2006.01) |

(52) U.S. Cl.

CPC ..... *A63B 21/0088* (2013.01); *A63B 22/06* (2013.01); *A63B 22/0605* (2013.01); *A63B 23/03525* (2013.01); *F04D 29/281* (2013.01); *F04D 29/30* (2013.01); *F04D 29/624* (2013.01); *A63B 2022/0629* (2013.01)

(58) Field of Classification Search

CPC ..... A63B 21/0088; A63B 23/03525; A63B 22/0605; F04D 29/624; F04D 29/281; F04D 29/30

See application file for complete search history.

(56) References Cited

U.S. PATENT DOCUMENTS

| | | | | |
|---|---|---|---|---|
| 5,341,565 | A * | 8/1994 | Kuryliw | F04D 29/388 29/889.72 |
| 5,795,270 | A * | 8/1998 | Woods | A63B 21/0088 482/62 |
| 6,733,239 | B2 * | 5/2004 | Lee | F04D 29/388 416/224 |
| 9,874,214 | B2 * | 1/2018 | Whitley | F04D 19/002 |
| 2011/0237397 | A1 * | 9/2011 | Mabey | A63B 22/0605 482/4 |
| 2017/0089346 | A1 * | 3/2017 | Oleson | F04D 25/088 |
| 2017/0274238 | A1 * | 9/2017 | Chou | A63B 21/0088 |
| 2018/0036574 | A1 * | 2/2018 | Schacht | A63B 69/16 |

FOREIGN PATENT DOCUMENTS

| | | |
|---|---|---|
| CN | 205478532 U | 8/2016 |
| TW | 386452 U | 4/2000 |

* cited by examiner

*Primary Examiner* — Megan Anderson
(74) *Attorney, Agent, or Firm* — Rosenberg, Klein & Lee

(57) ABSTRACT

An exercise bicycle configured to provide fan-based resistance and a fan wheel thereof are disclosed. The fan wheel includes a hub and a plurality of vanes. The hub includes a pivot portion and a plurality of mounting portions. The mounting portions are arranged in an annular manner around a center defined by the pivot portion and each have a groove. Each vane includes a connecting end inserted into a corresponding one of the mounting portions and fixedly connected to the corresponding mounting portion by a plurality of fasteners. The fan wheel is thus easy to manufacture and assemble.

9 Claims, 8 Drawing Sheets

EXERCISE BICYCLE CONFIGURED TO PROVIDE FAN-BASED RESISTANCE AND FAN WHEEL THEREOF

BACKGROUND OF THE INVENTION

1. Technical Field

The present invention relates to exercise bicycles and more particularly to one configured to provide fan-based resistance and having a fan wheel whose hub and vanes are manufactured separately and then put together.

2. Description of Related Art

Conventionally, the resistance-providing fan wheel of a fan-based exercise bicycle includes a hub integrally formed with a plurality of vanes. As the hub and the vanes are integrally formed, the mold required is highly complicated and hence expensive.

To lower the costs of such molds, Taiwan Patent No. 386452, entitled "Improved fan wheel structure of exercise bicycle configured to provide fan-based resistance", discloses symmetric enclosure portions and a plurality of vanes. The enclosure portions are wheel-like casings formed by stamping. The vanes are provided in the space between the enclosure portions and are soldered to the enclosure portions.

While the vanes in the afore-cited patent are fixed to the enclosure portions by soldering, it is well known in the art that soldering is disadvantageous in many ways. For example, a soldering technician is exposed to such risks as burns and inhalation of toxic gases, the high temperature of the soldering process may result in residual stresses, and a high level of craftsmanship is called for. Thus, the fan wheel structure in the afore-cited patent leaves something to be desired in terms of manufacture.

BRIEF SUMMARY OF THE INVENTION

To make it easier to manufacture the fan wheel of an exercise bicycle configured to provide fan-based resistance, the inventor of the present invention provides a fan wheel for use with an exercise bicycle, wherein the fan wheel includes a hub and a plurality of vanes. The hub includes a pivot portion and a plurality of mounting portions. The mounting portions are arranged in an annular manner around a center defined by the pivot portion and each have a groove. Each vane includes a connecting end. The connecting end of each vane is inserted into the groove of a corresponding one of the mounting portions and is fixedly connected to the corresponding mounting portion by a plurality of fasteners.

It is preferable that the hub includes two opposite lateral sides, that each groove penetrates the hub and is open on both lateral sides of the hub, and that each mounting portion includes a pressing surface adjacent to the groove of the mounting portion and configured to press against a corresponding one of the vanes.

The pressing surfaces are preferably tilted.

The pressing surfaces of the mounting portions are preferably tilted at substantially the same angle.

It is preferable that each mounting portion has two opposite positioning recesses, and that the connecting end of each vane has two opposite positioning plates configured to engage respectively with the positioning recesses of the corresponding mounting portion.

Preferably, at least one of the fasteners for each vane includes a threaded locking member and a screw nut, wherein the threaded locking member is passed through the positioning plates of the vane and the hub and is coupled with the screw nut.

Preferably, each mounting portion has a supporting rib extending away from the hub and configured to press against the corresponding vane.

Preferably, each vane has an end portion and a through slot between the connecting portion and the end portion.

Preferably, each vane further includes a weighting block fixedly provided at the end portion of the vane.

The inventor of the present invention also provides an exercise bicycle configured to provide fan-based resistance, wherein the exercise bicycle includes a bicycle body and a fan wheel. The bicycle body includes a frame. The fan wheel includes a hub and a plurality of vanes. The hub includes a pivot portion, a plurality of mounting portions, and two opposite lateral sides. The pivot portion is pivotally provided on the frame. The mounting portions are arranged in an annular manner around a center defined by the pivot portion and each have a groove and a pressing surface. Each groove penetrates the hub and is open on both lateral sides of the hub. The pressing surface of each mounting portion is adjacent to the groove of the mounting portion and is tilted. Each vane includes a connecting end inserted into the groove of a corresponding one of the mounting portions. The connecting end of each vane is pressed against the pressing surface of the corresponding mounting portion, is thereby tilted, and is fixedly connected to the corresponding mounting portion by a plurality of fasteners.

The technical features disclosed above can produce the following effects:

1. The hub and the vanes are formed separately to reduce the complexity, and lower the costs, of the molds respectively required to make the hub and the vanes. Moreover, the grooves in the hub allow the vanes to be positioned with ease in the initial stage of the assembly process and thus add convenience to assembly.

2. The tilted pressing surface adjacent to each groove of the hub helps tilt the corresponding vane at an appropriate mounting angle such that calibration for equilibrium can be dispensed with to further increase the ease of assembly. The tilted pressing surfaces of the hub also facilitate unmolding and therefore can be formed without difficulty.

3. The supporting ribs on the hub press against the vanes respectively to enhance the structural strength of the vanes.

4. During operation, the through slot in each vane can produce a disturbed airflow and thus generate a particular sound.

5. The weighing block provided at the end portion of each vane serves to increase the load on the user's body.

BRIEF DESCRIPTION OF THE SEVERAL VIEWS OF THE DRAWINGS

FIG. 4 B is another plan view of the hub of the fan wheel in FIG. 3;

DETAILED DESCRIPTION OF THE INVENTION

The present invention incorporates the foregoing technical features into a fan-based exercise bicycle. The major effects of the exercise bicycle and its fan wheel are demonstrated below by an embodiment of the invention.

Figure 1:
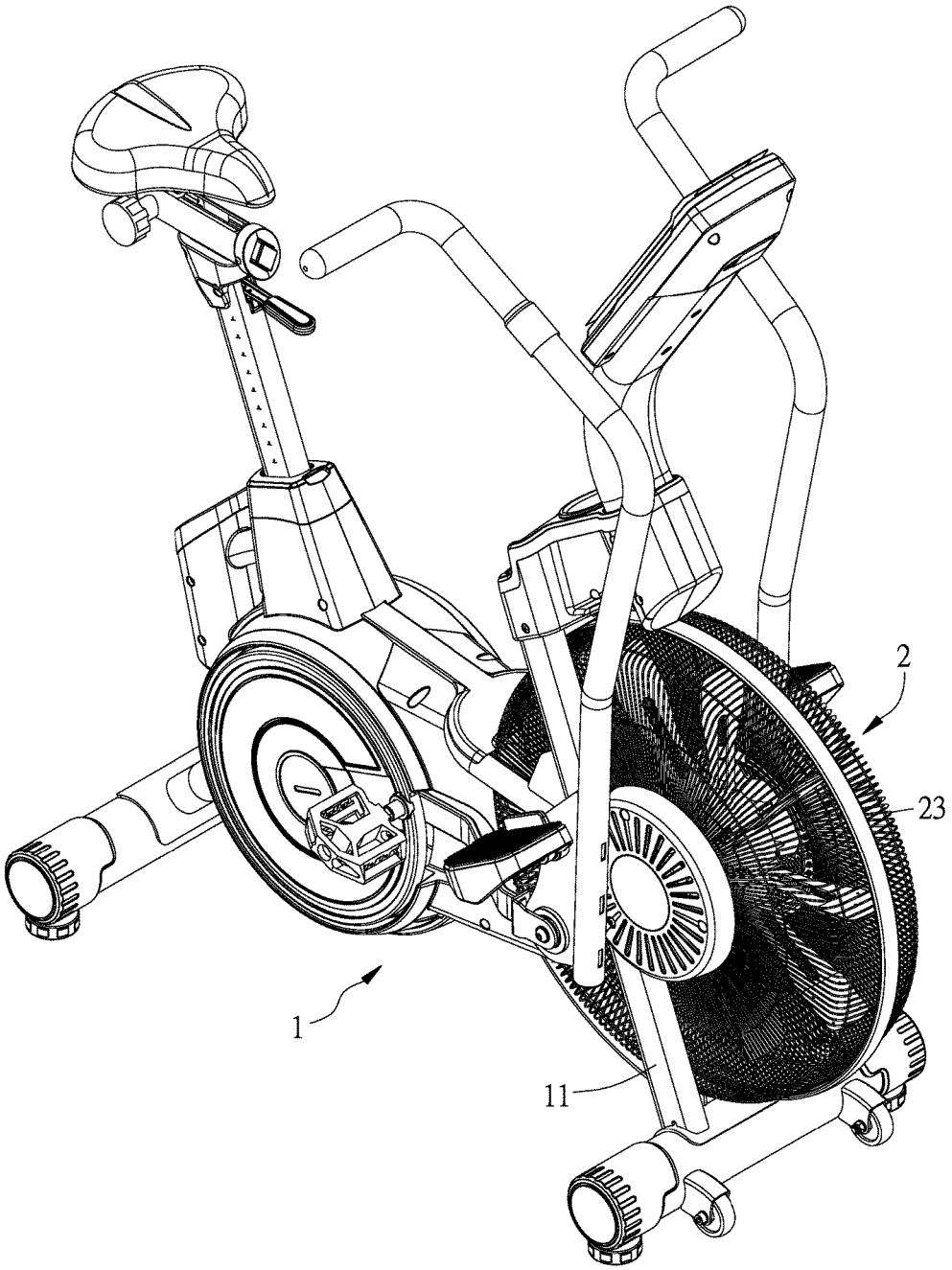
FIG. 1 is a perspective view of the exercise bicycle in an embodiment of the present invention.
Figure 2:
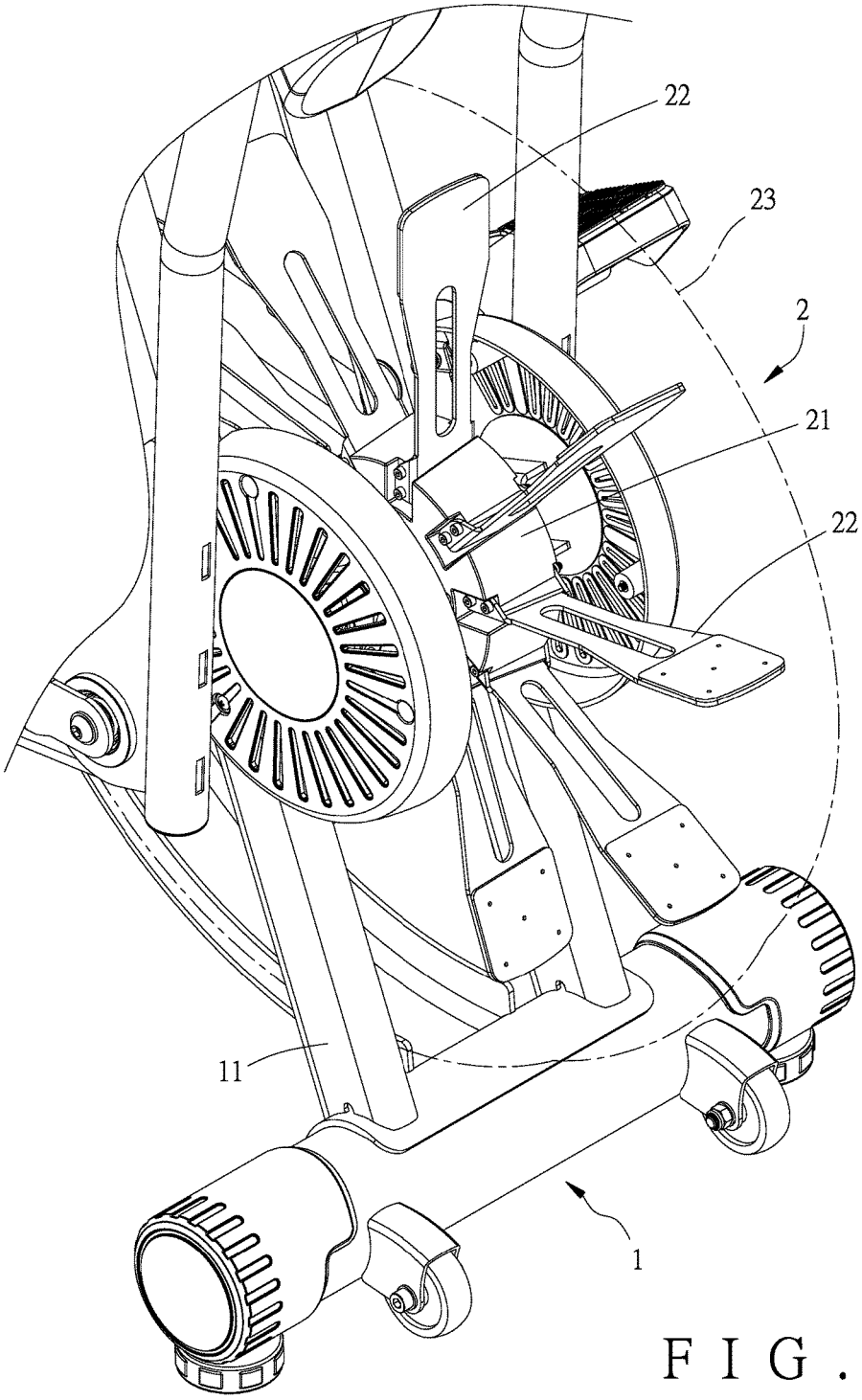
FIG. 2 is a partial perspective view of the exercise bicycle in FIG. 1.

Referring to FIG. 1 and FIG. 2, the exercise bicycle in an embodiment of the present invention essentially includes a bicycle body 1 and a fan wheel 2. The bicycle body 1 is in the form of a bicycle for example but is not necessarily so. The bicycle body 1 includes a frame 11, and the fan wheel 2 includes a hub 21, a plurality of vanes 22, and an enclosure 23. The enclosure 23 is configured to enclose the hub 21 and the vanes 22.

Figure 3:
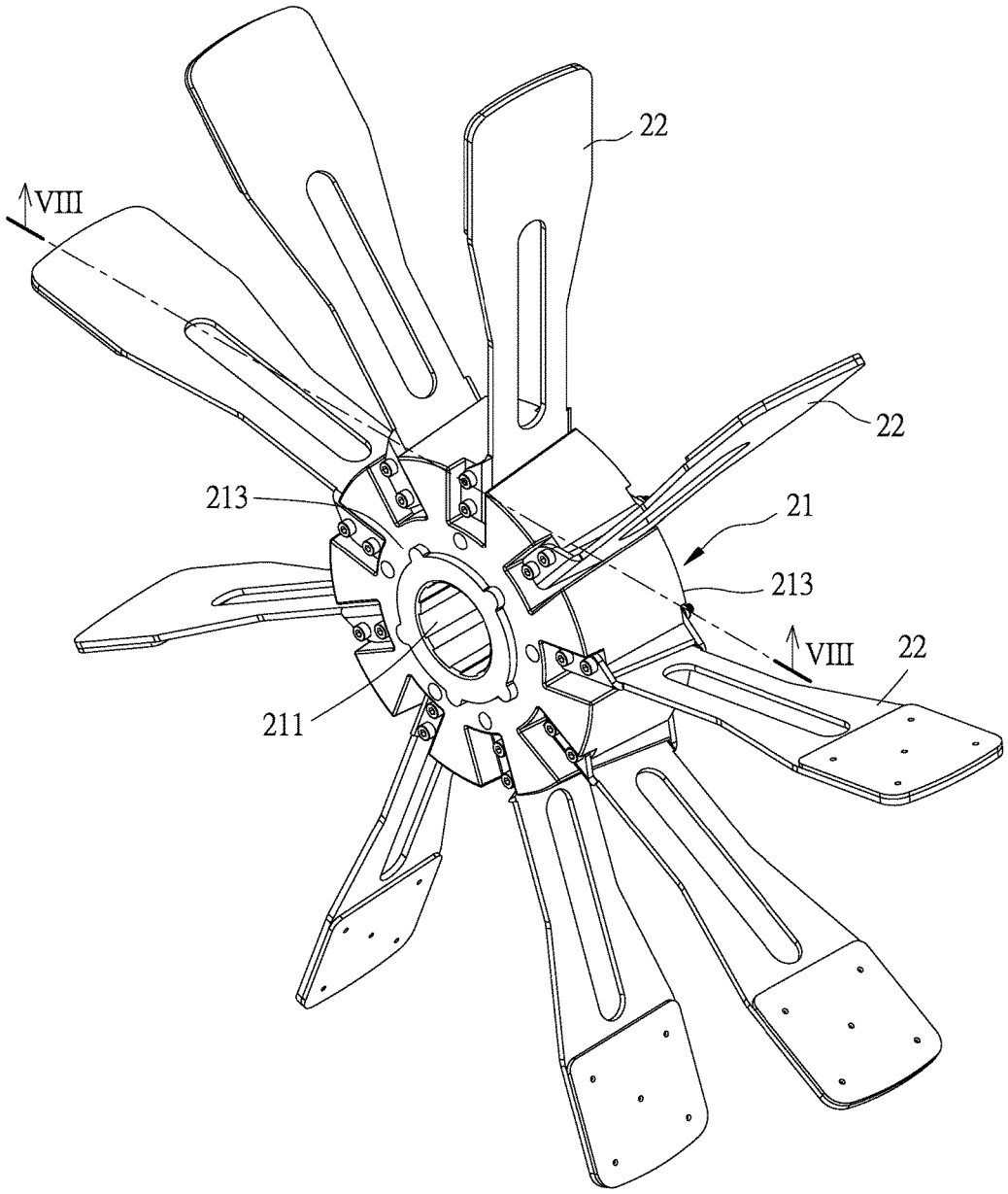
FIG. 3 is a perspective view of the fan wheel of the exercise bicycle in FIG. 1.
Figure 4A:
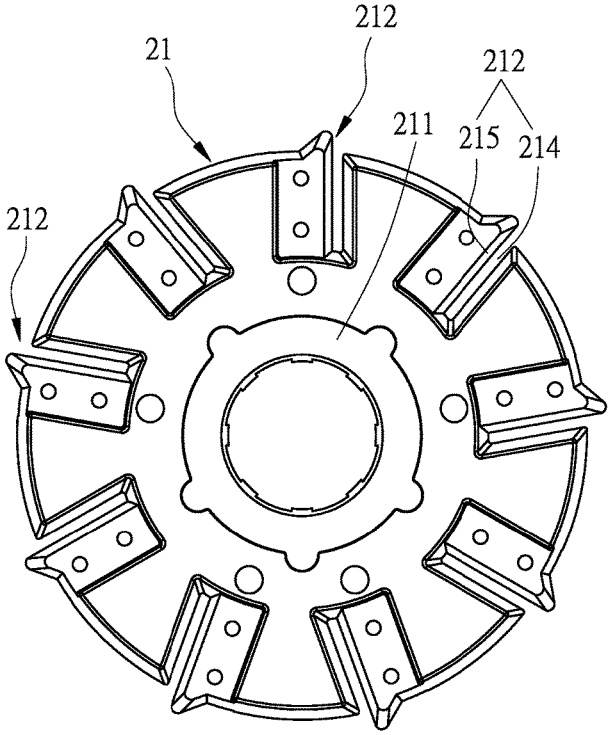
FIG. 4 A is a plan view of the hub of the fan wheel in FIG. 3.
Figure 4B:
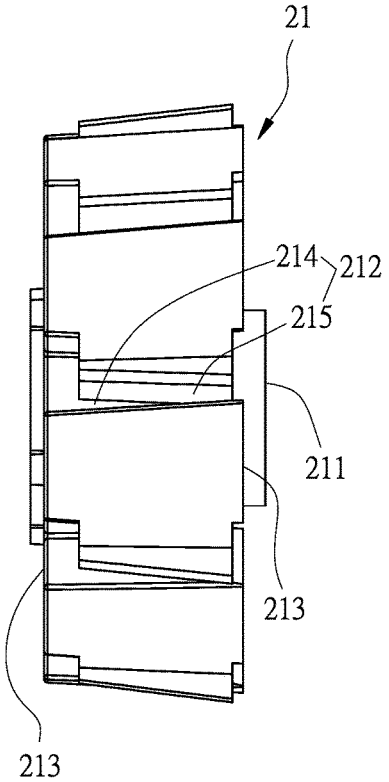
Figure 5:
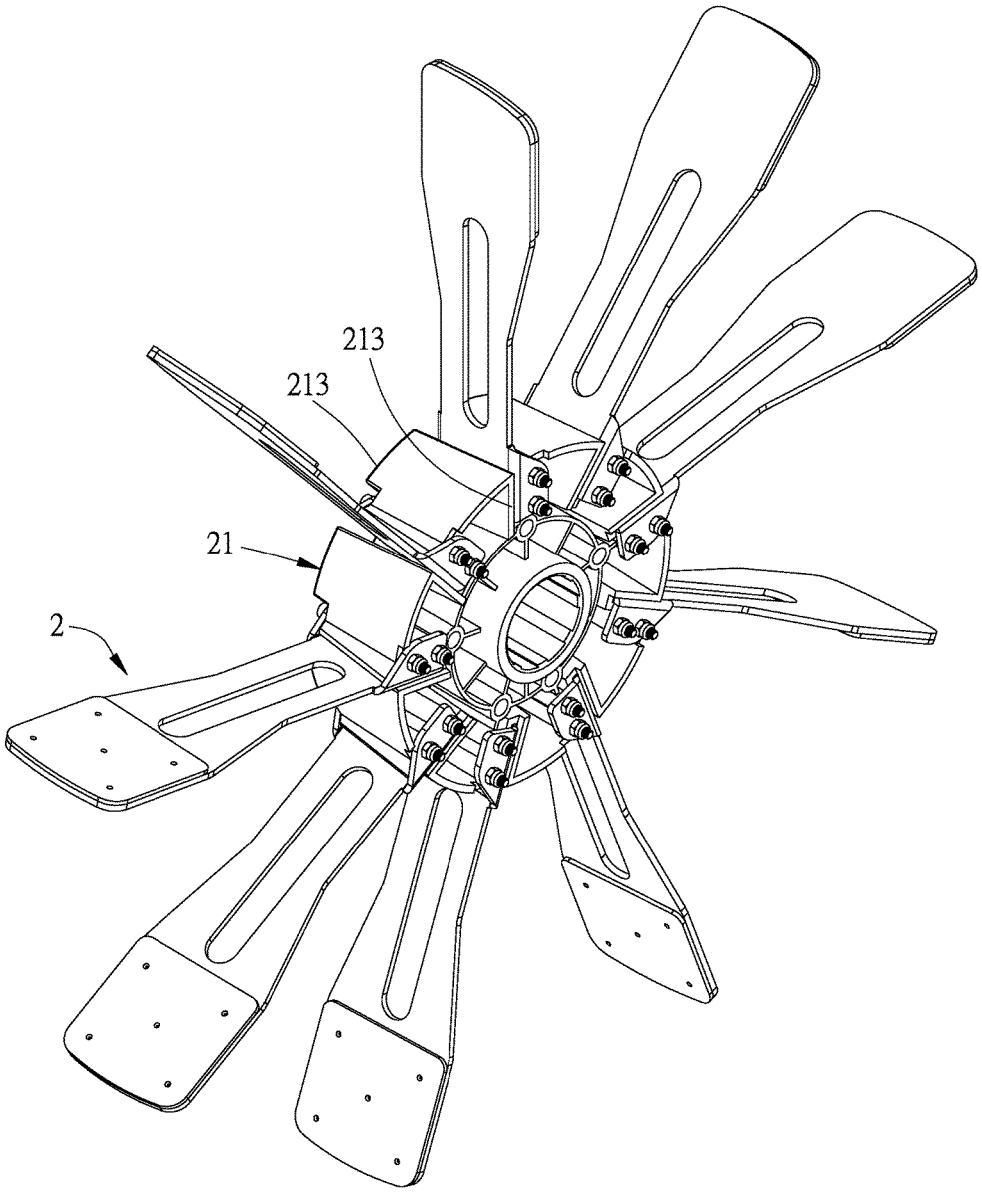
FIG. 5 is another perspective view of the fan wheel in FIG. 3.

Referring to FIG. 3 and FIG. 4A, the hub 21 includes a pivot portion 211, a plurality of mounting portions 212, and two opposite lateral sides 213. The pivot portion 211 is pivotally provided on the frame 11. The mounting portions 212 are annularly arranged around a center defined by the pivot portion 211 and are configured to be mounted with the vanes 22 respectively. As shown in FIG. 4A and FIG. 4B, each mounting portion 212 has a groove 214 and a pressing surface 215. The grooves 214 penetrate the hub 21 and are open on both lateral sides 213. The pressing surface 215 of each mounting portion 212 is adjacent to the groove 214 of the mounting portion 212 and tilted. The tilt angles of the pressing surfaces 215 of the mounting portions 212 are substantially the same to facilitate forming by and release from a mold. Since the hub 21 can be formed with a mold, one of the lateral sides 213 can be shaped as a housing (see FIG. 5).

Figure 6:
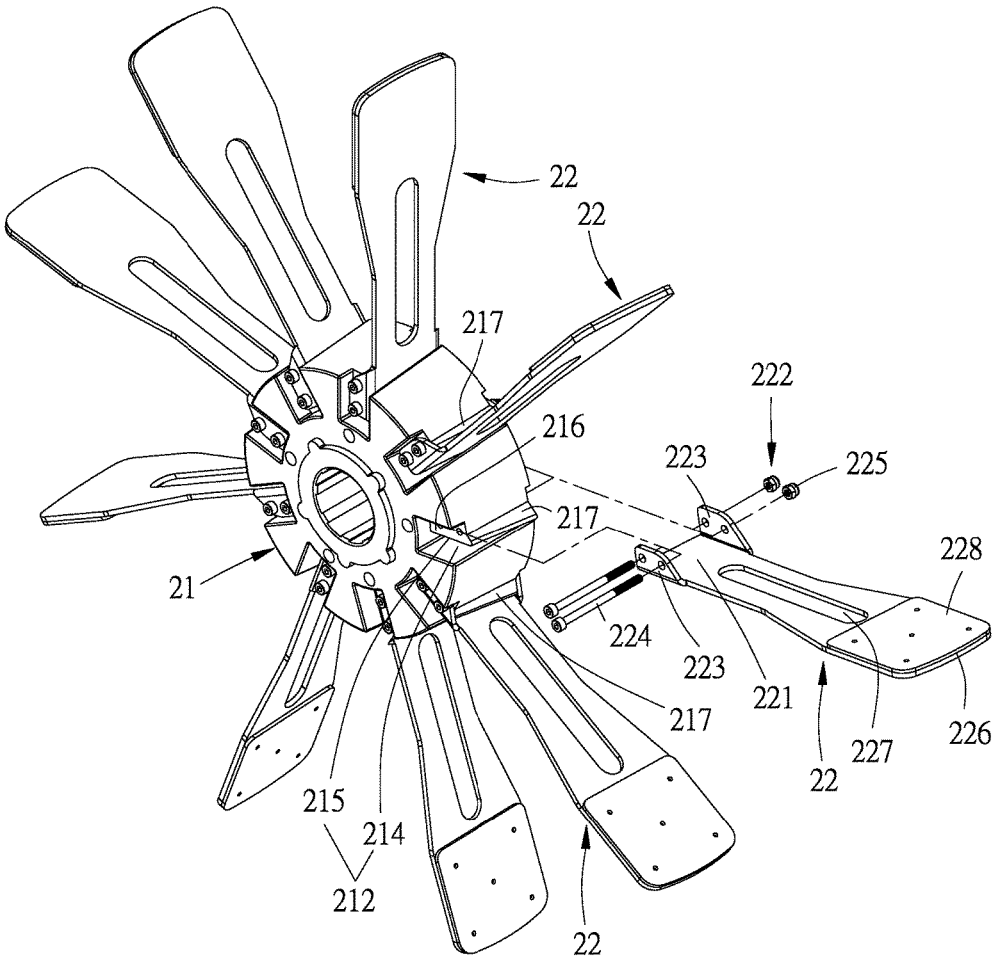
FIG. 6 is an exploded perspective view of the fan wheel in FIG. 3.
Figure 7:
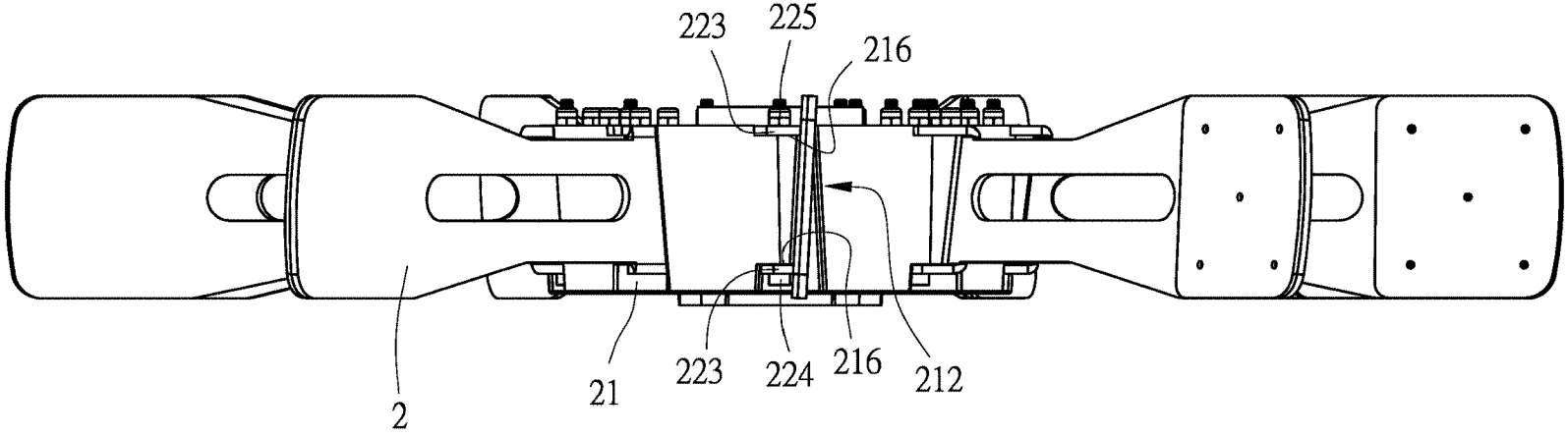
FIG. 7 is a plan view of the fan wheel in FIG. 3.
Figure 8:
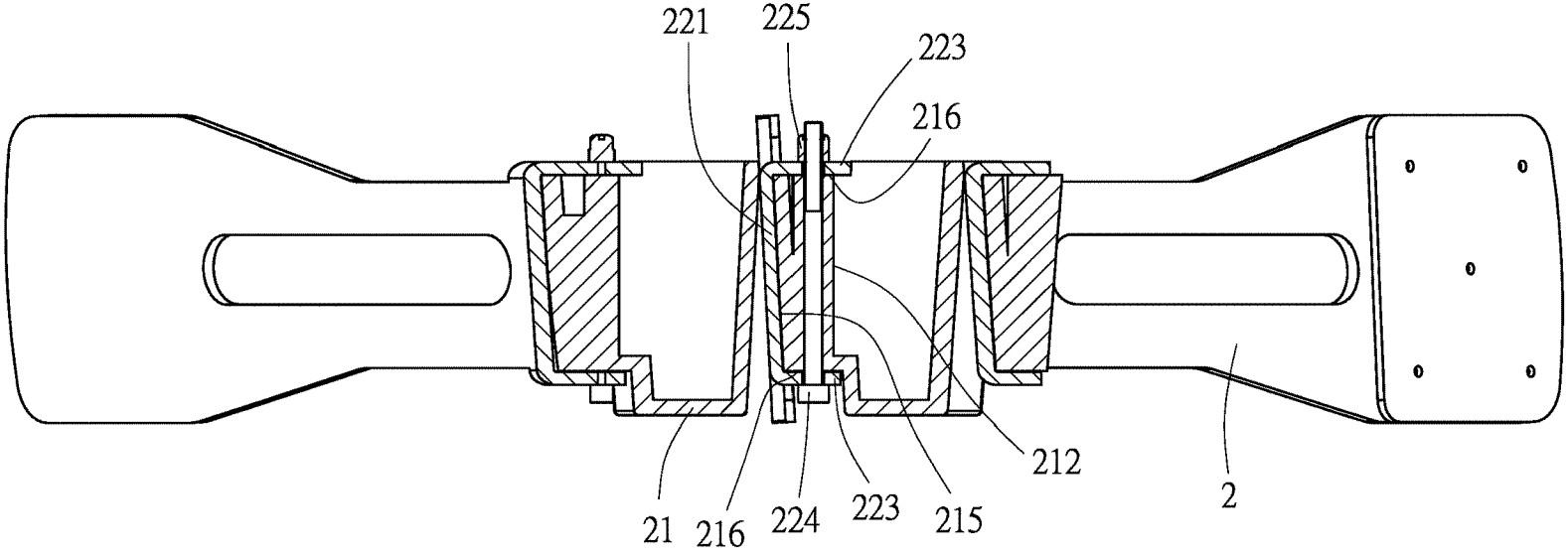
FIG. 8 is a sectional view taken along the line VIII-VIII in FIG. 3.

Referring to FIG. 6, each vane 22 includes a connecting end 221 configured to be inserted into the groove 214 of a corresponding one of the mounting portions 212 and fixedly connected to the corresponding mounting portion 212 via a plurality of fasteners 222. More specifically, as shown in FIG. 7 and FIG. 8, the connecting end 221 of each vane 22 is pressed against the pressing surface 215 of the corresponding mounting portion 212 and is consequently tilted, allowing the vane 22 to be mounted at an appropriate angle without further calibration for equilibrium. In addition, each mounting portion 212 has two opposite positioning recesses 216, and each connecting end 221 has two opposite positioning plates 223. The positioning plates 223 of each vane 22 are configured to engage respectively with the positioning recesses 216 of the corresponding mounting portion 212. The fasteners 222 for each vane 22 may each include a threaded locking member 224 and a screw nut 225, and each threaded locking member 224 is passed through the positioning plates 223 of the corresponding vane 22 and the hub 21 and is coupled with the corresponding screw nut 225. In practice, however, the fasteners 222 are not limited to the foregoing and may be rivets or other fastening elements instead.

Referring back to FIG. 6, it is preferable that each mounting portion 212 further has a supporting rib 217 extending away from the hub 21 to press against, and thereby increase the structural strength of, the corresponding vane 22. Moreover, each vane 22 has an end portion 226. Each vane 22 also has a through slot 227 between its connecting portion 221 and end portion 226 in order to generate a disturbed airflow during operation and thus produce a particular sound. Preferably, each vane 22 further includes a weighting block 228 fixedly provided (e.g., by locking, adhesive bonding, fastening, or other fixing means) at its end portion 226 to increase the load on the user's body.

The above description of the embodiment should be able to enable a full understanding of the operation, use, and effects of the present invention. The embodiment, however, is only a preferred one of the present invention and is not intended to be restrictive of the scope of the invention. All simple equivalent changes and modifications based on the disclosure of this specification and the appended claims should fall within the scope of the present invention.

What is claimed is:

1. A fan wheel of an exercise bicycle configured to provide fan-based resistance, comprising:

a hub comprising a pivot portion and a plurality of mounting portions, wherein the plurality of mounting portions are arranged in an annular manner around a center defined by the pivot portion and each of the plurality of mounting portions have a groove, each of said plurality of mounting portions have two opposite positioning recesses; and a plurality of vanes each comprising a connecting end, wherein the connecting end of each of said plurality of vanes is inserted into the groove of a corresponding one of the plurality of mounting portions and is fixedly connected to the corresponding one of the mounting portions by a plurality of fasteners, the connecting end of each of said plurality of vanes has two opposite positioning plates configured to engage respectively with the positioning recesses of the corresponding one of the plurality of mounting portions.

2. The fan wheel of claim 1, wherein the hub comprises two opposite lateral sides, each said groove of the plurality of mounting portions penetrates the hub and is open on both said two opposite lateral sides, and each said plurality of mounting portions comprises a pressing surface adjacent to the groove of each said plurality of mounting portions and configured to press against a corresponding one of the plurality of vanes.

3. The fan wheel of claim 2, where the pressing surfaces are tilted.

4. The fan wheel of claim 3, wherein the pressing surfaces of the plurality of mounting portions are tilted at substantially a same angle.

5. The fan wheel of claim 1, wherein each of said plurality of vanes has an end portion and a through slot between the connecting portion and the end portion.

6. The fan wheel of claim 5, wherein each of said plurality of vanes further includes a weighting block fixedly provided at the end portion thereof.

7. The fan wheel of claim 1, wherein at least one of the plurality of fasteners for each of said plurality of vanes comprises a threaded locking member and a screw nut, the threaded locking member extending through the two opposite positioning plates of the each of said plurality of vanes and the hub and being coupled with the screw nut.

8. A fan wheel of an exercise bicycle configured to provide fan-based resistance, comprising:

a hub comprising a pivot portion and a plurality of mounting portions, wherein the plurality of mounting portions are arranged in an annular manner around a center defined by the pivot portion and each of the plurality of mounting portions have a groove; and a plurality of vanes each comprising a connecting end, wherein the connecting end of each of said plurality of vanes is inserted into the groove of a corresponding one of the plurality of mounting portions and is fixedly connected to the corresponding one of the mounting portions by a plurality of fasteners, each of said plurality of mounting portions has a supporting rib extending away from the hub and configured to press against a corresponding one of the plurality of vanes.

9. An exercise bicycle configured to provide fan-based resistance, comprising:

a bicycle body comprising a frame; and a fan wheel comprising a hub and a plurality of vanes, wherein the hub comprises a pivot portion, a plurality of mounting portions, and two opposite lateral sides; the pivot portion is pivotally provided on the frame; the plurality of mounting portions are arranged in an annular manner around a center defined by the pivot portion and each of the plurality of mounting portions have a groove and a pressing surface; each said groove penetrates the hub and is open on both said two opposite lateral sides, each of said plurality of mounting portions has a supporting rib extending away from the hub and configured to press against a corresponding one of the plurality of vanes; the pressing surface of each of said plurality of mounting portions is adjacent to the groove of each of said plurality of mounting portions and is tilted; each said plurality of vanes comprises a connecting end inserted into the groove of a corresponding one of the plurality of mounting portions; and the connecting end of each of said plurality of vanes is pressed against the pressing surface of the corresponding one of the plurality of mounting portions, is thereby tilted, and is fixedly connected to the corresponding one of the plurality of mounting portions by a plurality of fasteners.

* * * * *